US005217218A

United States Patent [19]

Ricciardi

[11] Patent Number: 5,217,218

[45] Date of Patent: Jun. 8, 1993

[54] DUAL AUGER STACKING DEVICE AND CONTROL THEREFOR

[75] Inventor: Mario Ricciardi, Glenview, Ill.

[73] Assignee: Bell & Howell Company, Skokie, Ill.

[21] Appl. No.: 814,777

[22] Filed: Dec. 30, 1991

[51] Int. Cl.[5] ..... B65H 29/42

[52] U.S. Cl. ..... 271/176; 271/179

[58] Field of Search ..... 271/179, 176

[56] References Cited

U.S. PATENT DOCUMENTS

| | | | |
|---|---|---|---|
| 3,682,473 | 8/1972 | Kuyt | 271/179 X |
| 3,995,851 | 12/1976 | Casper . | |
| 4,252,308 | 2/1981 | Templeton . | |
| 4,270,747 | 6/1981 | Templeton | 271/179 |
| 4,509,739 | 4/1985 | Kurokawa | 271/179 X |
| 4,518,160 | 5/1985 | Lambrechts | 271/179 X |

*Primary Examiner*—Richard A. Schacher
*Attorney, Agent, or Firm*—Welsh & Katz, Ltd.

[57] ABSTRACT

A dual auger stacking device for use with a document sorting and conveying apparatus defining a document path and including a plurality of gates for diverting documents from the path into a preselected document receiving station of a plurality of such stations. Each station has a support structure for supporting planar surfaces of documents diverted by the gates and directing the documents into the receiving station. The stacking device includes a base plate upon which lower edges of sorted documents are conveyed upon being diverted by the gates, and an auger assembly operationally disposed relative to the base plate for pulling trailing edges of documents away from the support structure, for loosening documents stacked at the support structure for which the trailing edges have been pulled away, and for displacing the loosened documents into the document receiving station in a direction normal to the document path.

11 Claims, 2 Drawing Sheets

DUAL AUGER STACKING DEVICE AND CONTROL THEREFOR

BACKGROUND OF THE INVENTION

The present invention relates generally to document processing or handling systems having a document feeding and sorting function, wherein stacks of documents are scanned and sorted as to destination, and more particularly to a dual auger stacking device and corresponding control apparatus for such a system which facilitates the rapid stacking of documents diverted from a main document path.

Document processing or handling systems are known which include a feeder station into which stacks of documents are conveyed for singulation and are sequentially passed in a document path downstream for reading by an optical character reader or bar code reader. The reader determines into which of a plurality of document receiving stations each document will be diverted. As the document advances down the document path, an automatic diverter gate will be triggered by the reader to pivot and thus divert the document into the appropriate receiving or stacking station.

It has been found in the operation of such systems, when large volumes of documents are being rapidly handled and sorted, that stacks of documents often build up at a single document receiving station, and may become so tightly packed that the stacking of subsequent documents is impeded or prevented. Such tightly packed stacks of sorted documents have been known to become damaged to the point that further sorting and handling is difficult, if not impossible.

Thus, there is a need for a device for minimizing the document congestion at document receiving stations, and for expediting the movement of a diverted document away from the document path and towards the document receiving station.

Accordingly, it is an object of the present invention to provide a stacking device for a document handling and sorting system which prevents congestion at document receiving stations.

It is another object of the present invention to provide a document stacking device which receives diverted documents, which rapidly moves at least a portion of each document away from a diverter path, which loosens the stack of documents, and which moves the loosened documents toward the receiving station.

It is a further object of the present invention to provide a document stacking device which minimizes the congestion of diverted documents, and which operates only when documents are present in order to avoid damage to the lower edges of the documents.

It is a still further object of the present invention to provide a document stacking device including a control system which operates the device as a function of the sensing of a document in the document path which will be diverted to a particular document receiving station.

SUMMARY OF THE INVENTION

In carrying out the present invention, and in meeting or exceeding the above-identified objects, the present invention provides a dual auger stacking device and a control system therefor, wherein the device is positioned to receive diverted documents, to remove the documents from the diverter path, to loosen the stack of diverted documents, and to move the loosened documents away from the diverter and into the receiving station.

The invention also includes a control system for the device which triggers the operation of the dual auger device only when a diverted document is present. This latter feature prevents damage to documents held by the device when large volumes of documents are not moving through the diverter.

More specifically, the present invention provides a dual auger stacking device for use with a document sorting and conveying apparatus defining a document path and including a plurality of gates for diverting documents from the path into a preselected document receiving station of a plurality of such stations. Each station has a support structure for supporting planar sides of documents diverted by the gates and directing the documents into the receiving station. The stacking device includes a base plate upon which lower edges of sorted documents are conveyed upon being diverted by the gates, and an auger operationally disposed relative to the base plate for pulling trailing edges of documents away from the support structure, for loosening documents stacked at the support structure for which the trailing edges have been pulled away, and for displacing the loosened documents into the document receiving station in a direction normal to the document path.

In addition, the control system includes a document sensor positioned upstream of the diverter gate and electrically connected to the drive system for the auger. Upon the sensing of a document in the document path which is designated for diversion into a particular receiving station, the control system of the invention energizes the auger. Damage to the lower edges of documents held over the rotating auger threads is thus prevented.

DESCRIPTION OF THE PREFERRED EMBODIMENT

Figure 1:
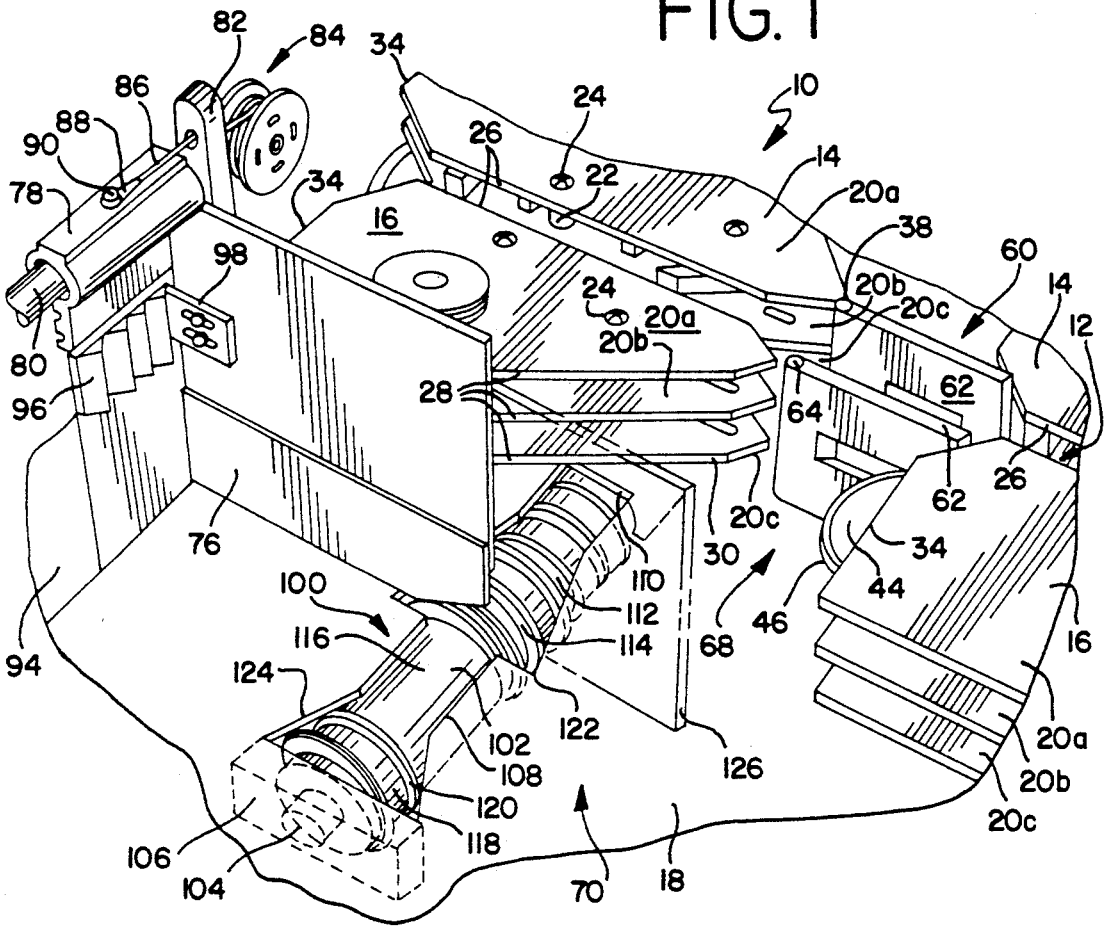
FIG. 1 is a fragmentary top perspective view of a document sorting and conveying apparatus incorporating the present dual auger stacking device.
Figure 2:
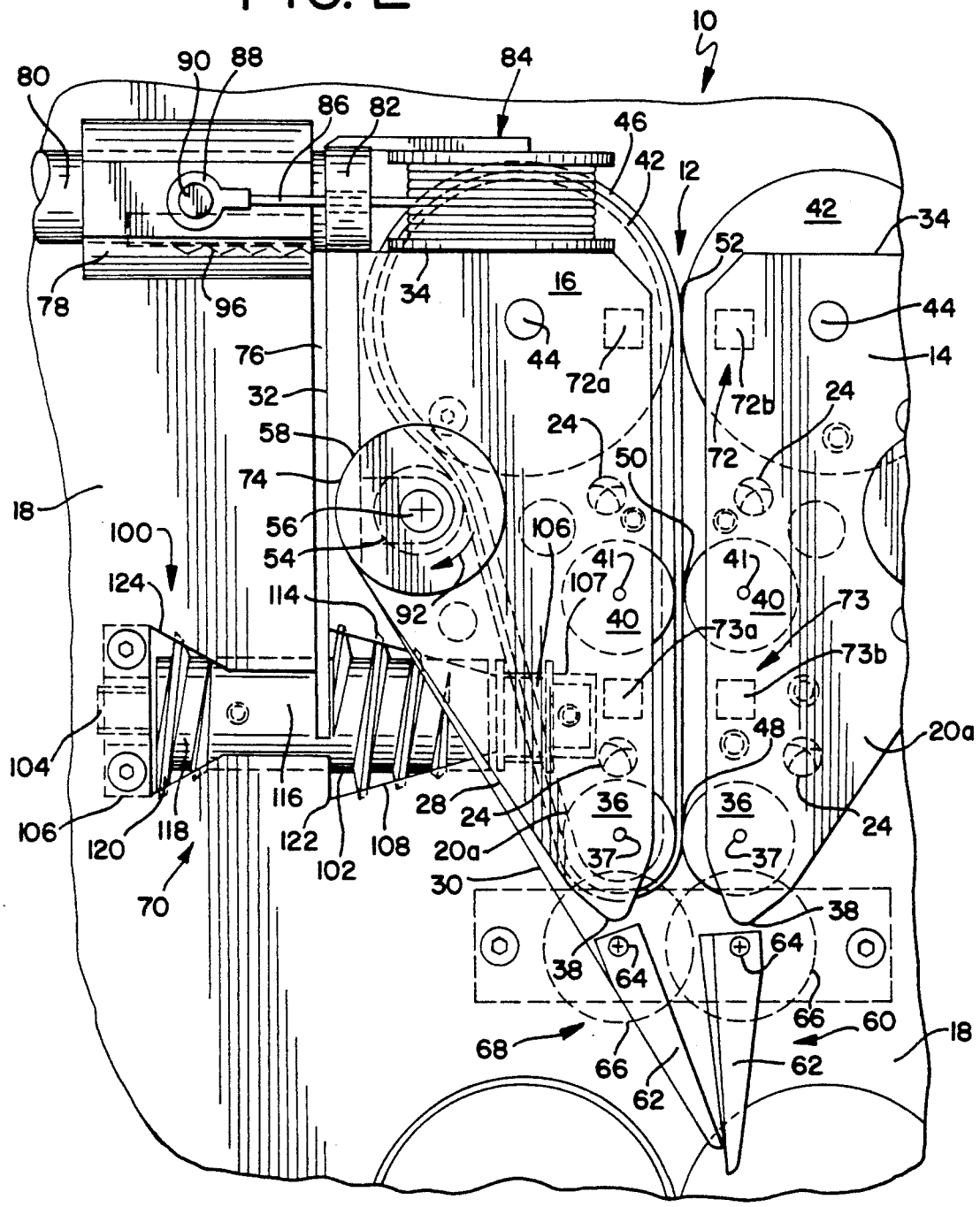
FIG. 2 is a plan view of the features illustrated in FIG. 1.

Referring now to FIGS. 1 and 2, a document processing or handling system having a document sorting function is generally designated at 10. The system 10 may include one or more upstream document processing stations, including, but not limited to a feed magazine, a feeder, a singulator, an optical character reader or a bar code reader. None of these stations are illustrated in the drawing, but are known in the art.

The function of the above-identified stations is to sense the desired destination of each document, such as by reading a postal zip code, and to advance the documents one-at-a-time in spaced edge-to-edge relation along a document path 12. The document path 12 is defined by a document conveying apparatus which in the preferred embodiment is a series of pairs of opposed conveyor frames 14, 16.

Each frame 14, 16 is secured to a base plate 18 of the system 10 and includes a plurality of vertically spaced, horizontally aligned plates 20, with three plates, designated 20*a*, 20*b* and 20*c*, being preferred. A plurality of vertically aligned spacers 22 maintain the plates 20*a–c* in spaced relationship, and are secured to the base plate 18 by a threaded fastener 24 passing through each spacer and into the base plate. The plates 20*a–c* are generally quadrilateral in shape, and have a longest side 26 defining the path 12, an angled side 28 defining a diverter path 30 and also having a portion 32 parallel to side 28, as well as a rear side 34. The plates 20*a–c* of each frame 14, 16 are identical, with the plates of frame 14 being positioned in inverted, mirror image relationship to the plates of frame 16.

Each frame 14, 16 has an idler roller 36 located on a shaft 37 near a point 38 in the frame formed by intersecting portions of the longest side 26 and the angled side 28. The idler roller 36 is preferably located between plates 20*b* and 20*c* to engage short as well as tall documents advancing along the path 12. Also included in each of the frames 14, 16 is a second idler roller 40 mounted on a shaft 41, and a drive roller 42 mounted on a powered drive shaft 44.

An endless conveyor belt 46 is trained about the rollers 36, 40 and 42 on the frame 16. The relative positions of the frames 14, 16 and the rollers 36, 40 and 42 are such that nips 48, 50 and 52 are created between the respective rollers and the belt 46 to advance documents along the path 12. To keep sufficient tension on the belt 46, an adjustable take up roller 54 is provided on a shaft 56 mounted to the frame 16. Shaft 56 is also provided with a plurality of feed rollers 58 which are of sufficient diameter to engage documents advanced along the diverter path 30.

Located in document path 12 directly ahead of each pair of frames 14, 16 is a diverter gate assembly 60. The gate assembly 60 includes a pair of rigid, generally planar diverter gates 62, each of which is mounted upon a pivot shaft 64. The gates 62 may be planar, as depicted in FIG. 1, or wedge shaped, as illustrated in FIG. 2. A drive source, such as a motor 66 (shown hidden) is located below the base plate 18, and is provided for each pivot shaft 64.

Diverter gates 62 are normally disposed in a first position indicated in FIG. 1, in which they are parallel to the path 12 and provide a surface for the support of documents as they advance across a gap 68 between adjacent pairs of frames 14, 16. However, upon the reader's generation of a signal that a specific document must be diverted into one of a plurality of document receiving stations 70, which are located on each side of the path 12, the diverter gate 62 is pivoted by motor 66 into a second, deflecting position exhibited by the left hand diverter gate indicated in FIG. 2.

In the deflecting position of gate 62, documents traveling along the path 12 will be intercepted by the gate 62 and diverted along the diverter path 30 into the document receiving station 70. Immediately after the diversion of a particular document, the diverter gate 62 will automatically resume the first position. The pivoting action of each gate 62 is controlled by the corresponding motor 66. A photosensor element 73, such as a photocell having components 73*a* and 73*b* straddling the document path 12 (best seen in FIG. 2), is located along the path 12 upstream of the corresponding diverter gate 62 and signals the motor 66 to pivotally displace the gate once the document passes the photosensor, after the reader has first determined that a particular station 70 is to receive the advancing document. A second photosensor element 72, comprising photocell components 72*a* and 72*b* also straddle document path 12 to detect jams in the document path. In FIG. 2, the photosensor element 72 is positioned for controlling the next downstream pair of diverter gates 62 (not shown).

Front and rear planar surfaces of diverted documents are supported by the angled sides 28 of the frame plates 20*a–c* as the documents are fed into a nip 74 formed between the feed rollers 58 and a stacker plate 76. The stacker plate 76 is mounted relative to the base plate 18 for reciprocal movement normal to the conveyor path 12. A tubular mounting barrel 78 is attached to an upper corner of the stacker plate 76 and is slidably engaged on a guide shaft 80 which is secured to the base plate 18 by a support bracket 82. The guide shaft 80 is disposed normally relative to the document path 12.

A return spring assembly 84 is preferably mounted to an upper end of the support bracket 82 and includes a cable 86 retractably attached at one end to the return spring assembly. A free end of the cable 86 is formed into a loop 88 which is secured upon a pin or lug 90 attached to the barrel 78.

Thus, as documents are diverted into the document receiving station 70, the stacker plate 76 is biased against the feeder rollers 58 to form the nip 74. The rotation of the feed rollers 58 in the direction indicated by the arrow 92 drives the documents against a retaining wall 94 (FIG. 1). With the sequential diversion of additional documents into the receiving station 70, the documents form a stack which eventually overcomes the biasing force of the return spring assembly 84. The stacker plate 76 is forced away from the document path 12 along shaft 80 as more documents are diverted into the station 70.

If desired, a ratcheted ramp 96 may be attached to the retaining wall 94 to engage a laterally projecting tab 98 mounted to the stacker plate 76. The engagement of the tab 98 with the ramp 96 is designed to restrain the backward movement of the stacker plate 76 until a sufficient number of documents are diverted into the receiving station 70. The construction and operation of the ramp 96 are described in greater detail in commonly assigned, copending application entitled "Stacker Assembly Having Variable Stacker Plate" Ser. No. 837,054, filed Feb. 18, 1992, which is incorporated herein by reference.

Figure 3:
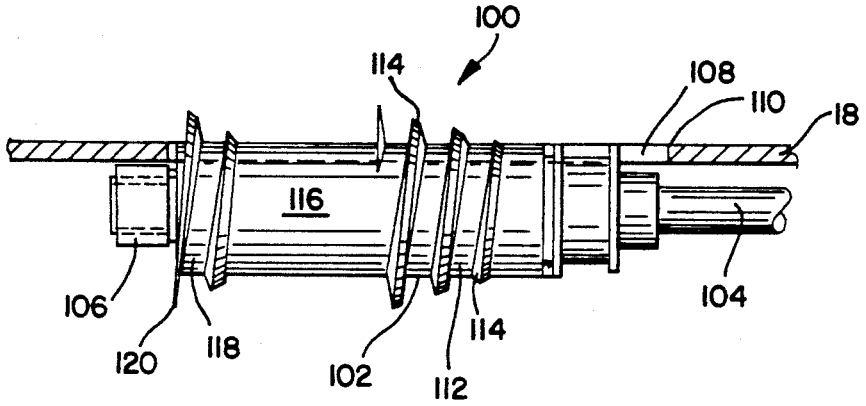
FIG. 3 is a side elevational view of the present dual stacking auger disposed in the document sorting and conveying apparatus shown in FIG. 1.

Referring to FIGS. 1–3, it has been found that congestion often occurs at, or slightly upstream of, the nip 74 when several documents are diverted into the document receiving station 70 in rapid succession. This congestion may impair the rapid sorting of documents, and has caused some document mutilation. To address this problem, the present dual auger assembly 100 is provided in the document sorting and handling system 10.

The dual auger assembly 100 includes an auger element 102 (FIG. 3) fixed to a drive shaft 104, the ends of which are engaged in bearing blocks 106 for rotation normal to the document path 12. The shaft 104 is powered by a drive source such as a motor 107 under automatic control. The shaft 104 and the anger element 102 are mounted to the base plate 18 to be in alignment with an opening 108 formed in the base plate normal to the document path 12, and having a first end 110 closely adjacent the diverter path 30.

Auger element 102 is operationally disposed relative to the base plate 18 for pulling the trailing edges of documents away from the plates 20*a–c* in a direction normal to the document path 12 after the documents have been directed to the document receiving station 70, for loosening documents stacked in close proximity to the support structure for which the trailing edges have been pulled away, and for displacing the loosened documents into the document receiving station 70 in a direction normal to the document path 12. The auger element 102 includes a first auger portion 112 located adjacent the first end 110 of the opening 108. A helical thread 114 is provided on the first auger portion 112 and is configured for pulling out the trailing edges of the documents caught in the nip 74 and supported by the plates 20*a–c*. The auger element 102 is mounted relative to the opening 108 so that only the thread 114 projects above the upper surface of the base plate 18 (best seen in FIG. 3.)

Next adjacent the first auger portion is a substantially smooth dwell portion 116 which is generally cylindrical and without threads. The dwell portion 116 is designed for stabilizing and loosening the stacked documents displaced by the first auger portion 112, and is disposed relative to the opening 108 so that documents held in the receiving station 70 will not actually be engaged by dwell portion 116.

A second auger portion 118 for displacing the loosened documents rearward into the document receiving station 70 is located on the auger element 102 rearwardly of the dwell portion 116. The second auger portion 118, which is coaxial with the dwell portion 116 and the first auger portion 112, is provided with a helical thread 120. As in the case with the thread 114 of the first auger portion 112, the thread 120 projects through the opening 108 above the surface of the base plate 18 to engage the bottom edges of the documents. The thread 120 is slightly shorter than the thread 114; however the threads 114 and 120 are preferably of substantially identical pitch. In the preferred embodiment, the opening 108 is provided with flared portions 122, 124 which are widened to accommodate the wider dimensions of the first and second auger portions, 112, 118, respectively.

If the auger element 102 is constantly rotating, regardless of the presence or absence of documents being diverted into the document receiving station 70, it is likely that documents already retained in the receiving station and held by the stacker plate 76 against the feed rollers 58, will become damaged from prolonged exposure to the rotating threads 114 and/or 120. Such damage is especially pronounced at the lower edge of the documents, one of which is shown at 124 in FIG. 1. To avoid this problem, it is preferred that the photosensor element 73 is also connected to the drive source of the drive shaft 104, such as through a conventional clutch mechanism (not shown), so that the auger element 102 does not rotate unless documents 126 are being diverted into the document receiving station 70.

In operation, indicia on a document advanced along the document path 12 are read by the reader as being designated for a specific document receiving station 70. A signal is sent by the reader to the photosensor element 73 so that once the document passes the photosensor, the diverter gates 62 will pivot to divert the document to the appropriate diverter path 30. The momentum of the document 126 advancing upon the base plate 18 and along the path 12 will carry it into the nip 74, where it will then be advanced against the retaining wall 94.

Assuming that there are other documents 126 already retained and forming a stack in the document receiving station 70, the trailing end of the diverted document will be pulled away from the supporting frame plates 20*a–c* to make room for subsequent documents. This pulling operation is performed by the first auger portion 112 of the auger element 102, which rotates responsive to a signal from photosensor element 73. The pulled-away trailing end is then moved across the dwell portion 116, and the remaining portion of the document follows, so that the documents forming the forward portion of the stack are loosened and stabilized prior to being moved rearward by the second auger portion 118. If, after a specified time period, such as approximately 2 seconds, no additional documents are diverted into the receiving station 70, the photosensor 73 is configured to temporarily halt the rotation of the auger drive shaft 104, and with it, the auger element 102. In this manner, unnecessary wear and/or mutilation of lower edges of diverted documents 126 by the rotating auger element 102 is prevented.

While a particular embodiment of the dual auger stacking device and control therefor of the invention has been shown and described, it will be appreciated by those skilled in the art that changes and modifications may be made thereto without departing from the invention in its broader aspects and as set forth in the following claims.

What is claimed is:

1. A dual auger stacking device for use with a document sorting and conveying apparatus defining a document path and including a plurality of gates for diverting documents from the path into a preselected document receiving station of a plurality of such stations, each station having a support structure for supporting planar surfaces of documents diverted by the gates and directing the documents into the receiving station, said stacking device comprising:

a base plate upon which lower edges of sorted documents are conveyed upon being diverted by the gates; and auger assembly means operationally and rotatably disposed relative to said base plate for pulling trailing edges of documents away from the support structure, for loosening documents stacked at the support structure for which said trailing edges have been pulled away, and for displacing said loosened documents into the document receiving station in a direction normal to the documents path;

control means for sensing the presence of documents diverted from the path, and for controlling the rotation of said auger assembly means in relation to the presence or absence of diverted documents.

2. The device as defined in claim 1 wherein said control means includes a photocell for triggering the operation of said gate, for sensing the presence of a document, and for energizing said auger assembly means.

3. The device as defined in claim 1 further including a stacking plate positioned in each of the receiving stations parallel to the document path and being biased for reciprocal movement transverse to the document path, with the amount of displacement of each said stacking plate being a function of the number of documents diverted into a corresponding one of the receiving stations.

4. The device as defined in claim 3 further including ramp means for controlling the reciprocal movement of said stacking plate.

5. A dual auger stacking device for use with a document sorting and conveying apparatus defining a document path and including a plurality of gates for diverting documents from the path into a preselected document receiving station of a plurality of such stations, each having a support structure for supporting planar surfaces of documents diverted by the gates and directing the documents into the receiving station, said stacking device comprising:

a base plate upon which lower edges of sorted documents are conveyed upon being diverted by the gates; and auger assembly means operationally and rotatably disposed relative to said base plate for pulling trailing edges of documents away from the support structure, for loosening documents stacked at the support structure for which said trailing edges have been pulled away, and for displacing said loosened documents into the document receiving station in a direction normal to the documents path;

said auger assembly means including an auger element having a first auger portion for pulling out the trailing edges of the documents supported by the support structure in a direction normal to the direction of travel of documents along the path, a dwell portion disposed beneath said base plate adjacent said first auger portion, for stabilizing documents displaced by said first auger portion, said dwell portion being out of contact with said documents as said documents move from said first auger portion, and a second auger portion for displacing said loosened documents into the document receiving station in a direction normal to the document path.

6. The device as defined in claim 5 wherein said first auger portion, said dwell portion and said second auger portion are coaxially disposed on a drive shaft.

7. The device as defined in claim 5 wherein said first and second auger portions are threaded, and said dwell portion is cylindrically shaped.

8. The device as defined in claim 7 wherein the threads of each of said first and second auger portions is provided with a pitch, and the respective pitch of each of said first and second auger portions is substantially identical.

9. The device as defined in claim 5 wherein said base plate has an opening, and said auger assembly means is disposed in said opening in normal orientation to the document path, so that only threads of said first and second auger portions project above said base plate for engagement of diverted documents.

10. A dual auger stacking device for use with a document sorting and conveying apparatus defining a document path and including a plurality of gates for diverting documents from the path into a preselected document receiving station of a plurality of such stations, each station having a support structure for supporting planar surfaces of documents diverted by the gates and directing the documents into the receiving station, said stacking device comprising:

a base plate upon which lower ledges of sorted documents are conveyed upon being diverted by the gates, said base plate having an opening;

an auger assembly operationally and rotatably disposed in said opening relative to said base plate, said auger assembly having a first auger portion for pulling trailing edges of documents away from the support structure, a dwell portion disposed beneath said base plate for stabilizing and loosening documents stacked at the support structure for which said trailing edges have been pulled away, said dwell portion being out of contact with said documents as said documents move from said first auger portion, and a second auger portion for displacing said loosened documents into the document receiving station in a direction normal to the document path.

11. The device as defined in claim 10 wherein said auger assembly is disposed in said opening in normal orientation to the document path, so that only threads of said first and second auger portions project above said base plate for engagement of diverted documents.

* * * * *